US010582813B2

(12) United States Patent
Carter

(10) Patent No.: US 10,582,813 B2
(45) Date of Patent: Mar. 10, 2020

(54) MOTION SENSING TOILET TISSUE SPINDLE NIGHTLIGHT

(71) Applicant: Matthew Dale Carter, Alexandria, KY (US)

(72) Inventor: Matthew Dale Carter, Alexandria, KY (US)

( * ) Notice: Subject to any disclaimer, the term of this patent is extended or adjusted under 35 U.S.C. 154(b) by 0 days.

(21) Appl. No.: 16/199,180

(22) Filed: Nov. 25, 2018

(65) Prior Publication Data

US 2019/0159638 A1 May 30, 2019

Related U.S. Application Data

(60) Provisional application No. 62/590,622, filed on Nov. 26, 2017.

(51) Int. Cl.

| | |
|---|---|
| ***A47K 10/38*** | (2006.01) |
| ***F21V 15/01*** | (2006.01) |
| ***F21V 19/00*** | (2006.01) |
| ***F21V 23/02*** | (2006.01) |
| ***F21V 23/04*** | (2006.01) |
| ***F21V 33/00*** | (2006.01) |
| ***F21S 8/00*** | (2006.01) |
| ***F21S 9/02*** | (2006.01) |
| ***A47K 10/32*** | (2006.01) |
| ***F21Y 115/10*** | (2016.01) |

(52) U.S. Cl.

CPC ..... *A47K 10/38* (2013.01); *F21S 8/036* (2013.01); *F21V 15/01* (2013.01); *F21V 19/003* (2013.01); *F21V 23/02* (2013.01); *F21V 23/04* (2013.01); *F21V 23/0471* (2013.01); *F21V 33/004* (2013.01); *A47K 2010/3233* (2013.01); *A47K 2010/389* (2013.01); *F21S 9/02* (2013.01); *F21Y 2115/10* (2016.08)

(58) Field of Classification Search

CPC ..... A47K 10/32; A47K 10/38; A47K 2010/3233; A47K 2010/389; F21S 8/036; F21S 9/02; F21V 15/01; F21V 19/003; F21V 23/04; F21V 23/0471; F21V 33/004; F21Y 2115/10

See application file for complete search history.

(56) References Cited

U.S. PATENT DOCUMENTS

| | | | | |
|---|---|---|---|---|
| 8,206,003 | B1 * | 6/2012 | LaBarge | F21L 4/08 206/389 |
| 9,383,091 | B1 * | 7/2016 | Greco | F21V 33/004 |
| 9,445,699 | B2 * | 9/2016 | Mangrum, Jr. | F21V 33/004 |
| 9,772,078 | B2 * | 9/2017 | Suggs | F21S 9/02 |
| 10,321,792 | B2 * | 6/2019 | Kennedy | A47K 10/32 |
| 2008/0184475 | A1 * | 8/2008 | Sladick | A47K 17/022 4/576.1 |
| 2017/0280947 | A1 * | 10/2017 | Yocom | A47K 10/3836 |
| 2018/0220859 | A1 * | 8/2018 | Laundre | A47K 13/24 |

* cited by examiner

*Primary Examiner* — Peggy A Neils
(74) *Attorney, Agent, or Firm* — Wood Herron & Evans LLP

(57) ABSTRACT

A device that provides temporary bathroom and toilet area illumination is provided. The device is best characterized as a toilet tissue spindle nightlight, containing various electronic subassemblies that operate together as a bathroom night lighting system. The spindle is capable of sensing movement, or vibrations, when a user accesses the roll of toilet tissue being held by the spindle. When movement is detected, the spindle automatically activates an integrated light to provide temporary and effective bathroom area illumination.

16 Claims, 3 Drawing Sheets

FIG. 2
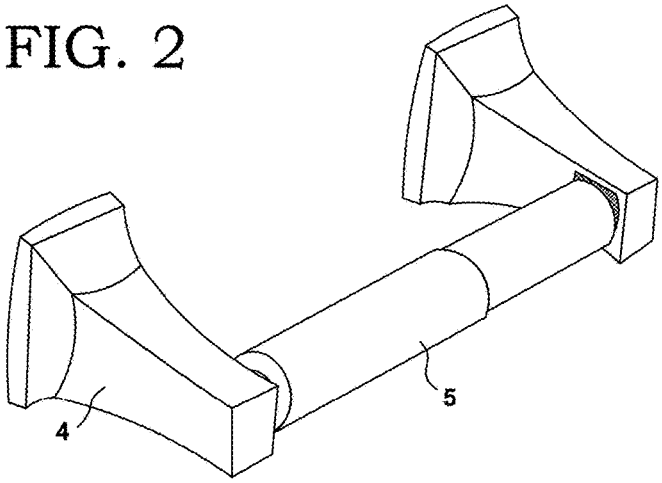
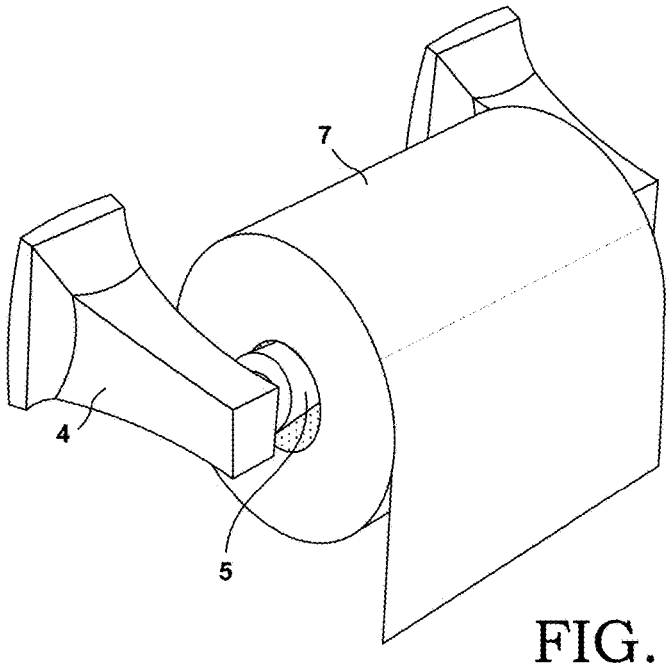
FIG. 3
FIG. 4
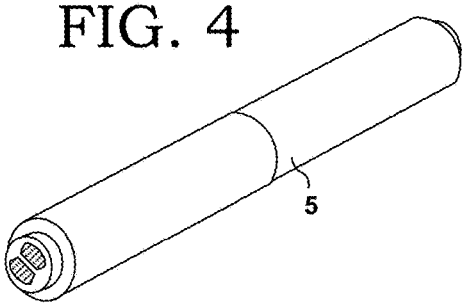

MOTION SENSING TOILET TISSUE SPINDLE NIGHTLIGHT

This application is claiming priority and benefit from U.S. Provisional Patent Application No. 62/590,622, filed Nov. 26, 2017 for "An illuminating toilet tissue spindle night light". The present invention relates to a movement sensing toilet tissue spindle nightlight, capable of holding toilet tissue, and that illuminates the surrounding bathroom area near and around the toilet when in use.

BACKGROUND OF THE INVENTION

It is common that some people need to use the bathroom at night, often when awaking from nightly sleep. Generally, a person can navigate their room environment under low lighting conditions to make their way to a bathroom; however there is not always sufficient lighting when using the bathroom, unless a normal bathroom light is switched on. Turning a bathroom light on when awakening from sleep can be hard on a person's eyes to adjust to sudden bright light. Further, bright lights can cause adverse sleep affects when returning back to bed, as light is naturally tied to our daily sleep and wake cycles. Although not turning on a light source at all, can lead to a user accidently making a mess on or around the toilet area when not well lit, and/or while going in a sleepy state.

While there are various types of nightlights sold today, there remains a need for a bathroom nightlight that is well-integrated into the bathroom environment; further one that can automatically illuminate the bathroom area when in use, regardless of sitting or standing positions. Such a nightlight would not impose unnecessary device clutter in the bathroom, or consume sparsely populated electrical outlets, or attach upon unsanitary toilet fixtures; but rather one that is well integrated enough it becomes seamless or unnoticeable. A well-integrated bathroom nightlight would also provide good toilet area illumination, while leveraging integration with commonly encountered bathroom fixture hardware, and is ultimately placed in an easily accessible, sanitary location near a toilet.

SUMMARY OF THE INVENTION

In one aspect of the present invention, a toilet spindle nightlight comprises: a toilet tissue spindle that is positioned between toilet tissue holder hardware designed to hold a roll of toilet tissue, this holder hardware is typically affixed to a wall or standing object near a toilet; a light within the spindle that illuminates the spindle ends or housing; a power source that electrically connects the light; a collection of electronic subcomponents that include vibration and movement sensing circuitry, a switch and logic timing system operatively connected to the light, wherein the switch is activated under various modes to turn the light on and off. The general purpose of the present invention is to provide an improved, well-integrated, method for toilet area illumination in low lighting or night time conditions.

The details of this invention will become apparent from the drawings, detailed description, and claims explained herein.

BRIEF DESCRIPTION OF THE DRAWINGS

FIG. 2 is a front perspective view of an embodiment of the present invention with bathroom hardware;

FIG. 3 is a front perspective view of an embodiment of the present invention holding toilet tissue;

FIG. 4 is a front perspective view of an embodiment of the present invention housing assembly;

DETAILED DESCRIPTION OF THE INVENTION

Figure 1:
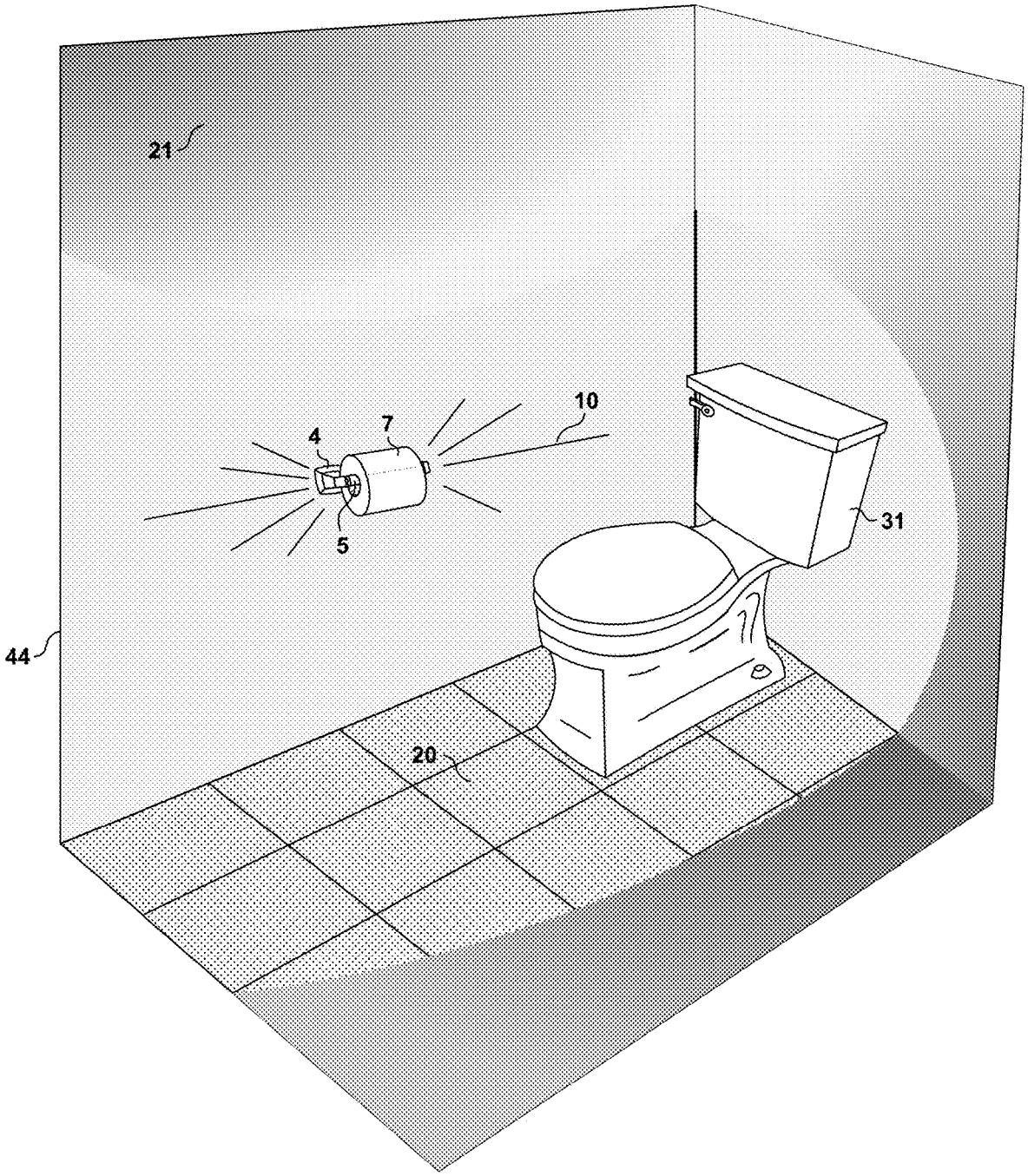
FIG. 1 is a perspective view of an embodiment of the present invention shown in operation.

The following detailed description is designed to explain the exemplary embodiments of the current invention. Variations of the exemplary embodiments may exist. This description is to be used in conjunction with the appended diagrams, which together best illustrate and explain the method of carrying out one or more exemplary embodiments of the invention. The descriptions and diagrams are not to be taken in a limited sense; but used to support the scope and claims of the current invention.

The present invention includes a bathroom nightlight that has been well-integrated into a toilet tissue spindle kind of apparatus. In one embodiment the spindle, also referenced as the lighting housing, holds a roll of standard sized toilet tissue commonly found in bathrooms (e.g. a toilet tissue roll that typically measures 4.5" W×4.5" H×4.5D"). The spindle is suspended between standard toilet tissue holder hardware, also commonly found in hardware stores and pre-installed in many residential homes; this toilet tissue holder hardware is typically affixed to a wall or other standing object near the toilet to aid in dispensing toilet tissue. However, in the present invention the spindle also includes a plurality of well-integrated electronic subassemblies comprising a lighting system for when movement is sensed, the light automatically illuminates for a temporary amount of time before returning to an "off" or "standby" or "ready" state. In the current invention the spindle acts as the dispenser that holds the toilet tissue, and serves as the lighting housing that contains various electronic subassemblies of the well-integrated bathroom night lighting system. These subassemblies include a power source using batteries to activate spindle circuitry, and ultimately provide power to the light during use. In one embodiment, the lighting within the spindle is comprised of Light Emitting Diodes (LED's) that offer adjustable levels of intensity, color, and/or patterns of illumination. When the spindle is illuminated it provides sufficient lighting to use the bathroom at night or under low lighting conditions without stressing the eyes against sudden bright lights from a residential room light bulb. As an example, an overhead room light bulb may operate at higher voltage such as 110/120 VAC@60 W producing approximately 800 lumens of light intensity, whereas a nightlight operating at a lower voltage such as 4.5 VDC@2 W may only produce 40 lumens of light intensity. The nightlight in the above example operates at only 5% of the brightness level of the overhead room light, yet still provides ample lighting around the toilet during night time or low lighting conditions. This decreased lumens value, is easier on a person's eyes when waking up in the middle of the night to use the bathroom. While reduction of sudden eye fatigue/stress is one benefit of a nightlight, lower light intensity will help preserve the body's natural sleep rhythm during a short period of awakening such as a bathroom visit. The location of the nightlight being conveniently located near the toilet also makes it readily available for users when needed. In the same embodiment, the spindle contains an Integrated Circuit Board with movement and vibration detection circuitry, which is specifically tuned for user interaction. Some examples of movement may include vibrations to the spindle caused by a user intentionally touching or tapping the roll of toilet tissue, and/or the toilet tissue roll in movement, and/or the toilet tissue spindle in movement. The sensed vibration, or movements, may operatively allow the spindle to automatically illuminate for a temporary period of time, then returning to an off or standby state. This switching mechanism provides advantages in energy conservation by automatically turning the light on and off to extend battery life of the system. The switching mechanism also offers user conveniences in auto modes by ensuring the light extinguishes after use and returns to a ready state for the next use. The movement detection circuitry may be comprised of a low-power multi-axis MEMS (Micro Electro-Mechanical System) accelerometer that can detect physical vibration, or movement, of the toilet tissue spindle. There are a variety of accelerometer types that may be used (e.g. Piezoelectric, Piezoresistive, Capacitance Sensing) to detect movement; additionally vibration sensors themselves are a form of accelerometers, measuring a quantity of acceleration. It's important to note that the current invention uses an accelerometer sensor type that detects its own movement, which is not to be confused with a motion sensor that detects oncoming or approaching objects/users with light such as a PIR (passive infrared sensor) or photocell. A MEMS accelerometer sensor is a type of sensing device that measures acceleration across one or more orthogonal axis (X-axis, Y-axis, and/or Z-axis) and turns mechanical energy into electrical signals—analog or digital. Three dimensional digital MEMS accelerometers are becoming increasingly popular in small portable electronic devices to detect physical changes about a device, and inform a user through a number of feedback methods. The MEMS accelerometer can further be integrated into the system by adding an onboard microcontroller that incorporates controls for features such as timers and counters that are responsible for various aspects of system illumination timing, light intensity, illumination color, lighting control, power management, sensor movement sensitivity, and/or operational status and feedback (e.g. low battery indication) as examples. While these are just some of the capabilities of an embedded microcontroller, other future feature enhancements are made possible by adding a logic processor onboard. Other aspects of the Integrated Circuit Board may include common electronic components including but not limited to: wiring, connectors, leads, resistors, potentiometers, capacitors, inductors, diodes, light emitting diodes, transistors, oscillators, integrated circuits, microcontrollers, microprocessors, memory, sensors, relays, switches, or batteries. This Integrated Circuit Board may be miniaturized and power optimized to fit inside the spindle housing with the associated battery power source connected. The LED's may be positioned within the housing too, in one embodiment the LED's may be mounted on separate circuit boards (e.g. disk shapes) and can be faced in opposing directions so light is directed towards the ends of the spindle to direct light outwards of the toilet paper roll for optimal lighting. In other embodiments LED's may be integrated using an LED lighting strip(s) that line the interior side(s) of the spindle housing. Further, the spindle housing itself may be constructed of a transparent or semi-transparent plastic material allowing light to effectively pass through it, creating a glowing effect against the housing when the LED's are illuminated from within it. It remains important to easily remove the spindle from the toilet tissue holder to replenish toilet tissue rolls, exchange batteries in the spindle, or performing other maintenance associated to the toilet tissue spindle's functionality. In one embodiment, the spindle may be spring loaded to create a tension mechanism between the toilet tissue holders, thus suspending the spindle between the holders securely. In another embodiment the spindle may incorporate extrusions internal to the housing that can assist holding electronic subassemblies, in addition to facilitating the spindle housing pieces staying together, and assisting the spindle's ability to compress or expand between the toilet tissue holder hardware. In another embodiment the spindle housing may be comprised of joining telescopic pieces to assist in securing the housing to the toilet tissue holder hardware. In another embodiment, a combination of the spring loaded tension mechanism, integrated extrusion mechanisms, and/or joining telescopic parts may be used to properly secure the spindle between the toilet tissue holder hardware, while holding a roll of toilet tissue. While the details around securing the toilet tissue spindle to a holder remain important, the primary function of the invention is generally related to the illumination functionality of the toilet tissue spindle making it a unique and specific type of bathroom nightlight.

Figure 5:
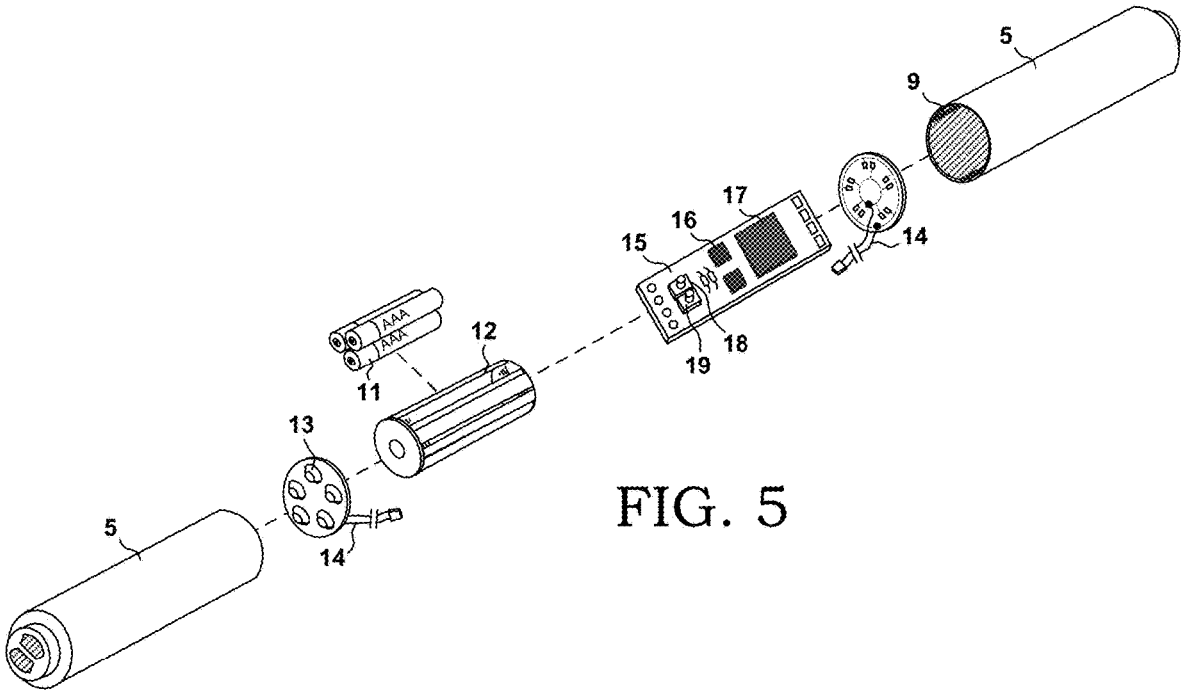
FIG. 5 is an exploded view of an embodiment of the present invention.

Referring to FIGS. 1 through 5, the present invention includes a toilet tissue spindle nightlight. The toilet tissue spindle nightlight includes a semi-transparent housing 5 that is designed to be installed with standard bathroom toilet tissue hardware 4 to hold a roll of standard toilet tissue 7. A light 13 is well-integrated within the housing 5 and is electrically connected 14 to a power source 11, 12. In certain embodiments electronic subassemblies are contained within the housing 5 such as a circuit board 15. In certain embodiments the circuit board 15 may contain a plurality of other electronic components such as an accelerometer 16 and microcontroller 17 that can operatively control the light 13. In certain embodiments the circuit board 15 may contain a user switch 18 and/or selector 19 to expose various controls and settings such as on, off, and auto modes; movement sensitivity, timer controls, lighting colors and intensity; and/or other logically controlled features of the present invention. In certain embodiment's the user switch 18, or other controlling selectors 19, may be exposed through the housing 5 for ease of use.

The present invention when installed in a bathroom 44 provides illumination 10 when a user intentionally moves or taps the spindle housing 5 or associated toilet tissue 7. The user applied movement is then detected by the embedded spindle sensor, in this case an accelerometer 16, and tuned accordingly to detect user vibration or intentional contact. When the current invention is set to auto mode, and spindle movement is detected, the spindle will automatically illuminate 10 the bathroom area 20 for a specific and temporary amount of time, such as 60 seconds using a system switch and system timer. The system timer may be reset before the expiration period so long as additional spindle movement is detected within the current illumination 10 time frame to start the system timer over again. If the time frame expires, and there are no further movement activities being sensed, the light 13 will extinguish automatically via the system switch, and the spindle will return to a standby/ready state for the next user.

In certain embodiments, the current invention may include a microcontroller 17 to provide logic functions including a system switch, system timer, power source 11, 12 management, light 13 management, sensor management, and device feedback (e.g. low battery indication). In another embodiment the light 13 may be an LED (Light Emitting Diode). In certain embodiments, the housing 5 may be transparent or semi-transparent, and contain extruded sections 9 that assist in securing the spindle housing 5 together and/or securing the integrated circuit board 15 from moving about the housing 5.

It should be understood that the foregoing descriptions relates to the exemplary embodiments of the invention and that modifications, or variations, may exist without departing from the actual intent, scope, or purpose of the invention as set forth in the following claims.

The invention claimed is:

1. A toilet tissue spindle nightlight comprising:

a housing configured as a rotatable toilet tissue spindle dispenser, the housing having an interior cavity including electronic components or subassemblies used for lighting;

a light disposed within the interior cavity of the housing;

a power source disposed within the interior cavity and electrically connected to the one or more of the electronic components or subassemblies;

a sensor disposed within the interior cavity and configured to detect physical movement;

a microcontroller disposed within the interior cavity; and a circuit board disposed within the interior cavity, wherein the power source, the light, the sensor, and the microcontroller are electrically connected to the circuit board;

wherein when the sensor detects physical movement, the microcontroller activates the light, and wherein the light remains on for a temporary period of time after the sensor has detected physical movement and then returns to an off or standby state.

2. The toilet tissue spindle nightlight of claim 1, wherein the housing is comprised of translucent or semi-translucent plastic material to allow light to pass through it.

3. The toilet tissue spindle nightlight of claim 1, wherein the housing includes openings or perforations to allow light to pass through the housing.

4. The toilet tissue spindle nightlight of claim 1, wherein the light is one or more light emitting diodes (LEDs).

5. The toilet tissue spindle nightlight of claim 1, wherein the one or more LEDs are adjustable to any color, intensity, or illumination patterns.

6. The toilet tissue spindle nightlight of claim 1, further comprising a user switch and selector, each being operatively connected to the microcontroller and configured to change a setting of the microcontroller.

7. The toilet tissue spindle nightlight of claim 1, wherein the microcontroller includes logic functions configured to manage sensor movement sensitivity, system switch modes, system timer durations, lighting color selections, lighting patterns, lighting intensity selections, power management, and device feedback.

8. The toilet tissue spindle nightlight of claim 1, further comprising a system timer to manage the duration of time the light is turned on and turned off when movement is detected or becomes absent.

9. The toilet tissue spindle nightlight of claim 1, wherein the microcontroller includes a system timer configured to turn the light on or turn the light off automatically.

10. The toilet tissue spindle nightlight of claim 1, wherein the sensor is an accelerometer.

11. The toilet tissue spindle nightlight of claim 1, wherein the housing includes a first housing portion and a second housing portion telescopically fitted into the first housing portion to form the interior cavity.

12. The toilet tissue spindle nightlight of claim 11, wherein the second housing portion is spring biased relative to the first housing portion such that the housing may be removably secured to a toilet tissue holder.

13. The toilet tissue spindle nightlight of claim 1, wherein the housing has a cylindrical cross-section with a first diameter, the housing having a first end and a second end, wherein each end has a cylindrical extension with a second diameter smaller than the first diameter, each cylindrical extension configured to engage opposing openings in a toilet tissue holder.

14. The toilet tissue spindle nightlight of claim 1, further comprising a power switch operatively coupled to the power supply and configured to control power from the power supply to one or more of the electronic components or subassemblies.

15. The toilet tissue spindle nightlight of claim 6, wherein the user switch is configured to select an operational mode of the of the microcontroller, and wherein the selector is configured to select an operational mode setting within the selected operational mode.

16. The toilet tissue spindle nightlight of claim 15, wherein the operational mode includes at least one of a sensor movement sensitivity, a time duration, a lighting color, a lighting intensity, a lighting pattern, a power management, and device feedback.

* * * * *